US008967823B2

(12) United States Patent
D'Antonio

(10) Patent No.: US 8,967,823 B2
(45) Date of Patent: Mar. 3, 2015

(54) COMBINATION LIGHT DIFFUSER AND ACOUSTICAL TREATMENT AND LISTENING ROOM INCLUDING SUCH FIXTURES

(75) Inventor: Peter D'Antonio, Upper Marlboro, MD (US)

(73) Assignee: RPG Diffusor Systems, Inc.

( * ) Notice: Subject to any disclaimer, the term of this patent is extended or adjusted under 35 U.S.C. 154(b) by 145 days.

(21) Appl. No.: 13/614,057

(22) Filed: Sep. 13, 2012

(65) Prior Publication Data

US 2014/0071662 A1 Mar. 13, 2014

(51) Int. Cl.

| | |
|---|---|
| ***F21S 8/00*** | (2006.01) |
| ***F21V 5/04*** | (2006.01) |
| ***E04B 1/84*** | (2006.01) |
| ***F21V 21/04*** | (2006.01) |

(52) U.S. Cl.
CPC .. *E04B 1/84* (2013.01); *F21V 21/04* (2013.01)
USPC ..... 362/147; 362/331; 362/150

(58) Field of Classification Search
CPC ..... F21Y 2103/03; F21Y 2103/003; F21V 21/04; E04B 9/001; E04B 1/82; E04B 1/84; E04B 9/32
USPC ..... 362/147, 148, 150, 26, 331
See application file for complete search history.

(56) References Cited

U.S. PATENT DOCUMENTS

| | | | | |
|---|---|---|---|---|
| 2,334,484 | A * | 11/1943 | Dunbar | 362/150 |
| 2,854,565 | A * | 9/1958 | Kruger | 362/150 |
| 3,253,675 | A * | 5/1966 | Baruch | 181/289 |
| 3,380,552 | A * | 4/1968 | Segil et al. | 181/292 |
| 4,042,817 | A * | 8/1977 | McNamara, Jr. | 362/147 |
| 5,172,973 | A * | 12/1992 | Spada | 362/547 |
| 5,228,773 | A * | 7/1993 | Win | 362/339 |
| 5,782,551 | A * | 7/1998 | Capaul | 362/148 |
| 6,367,581 | B1 * | 4/2002 | Marler et al. | 181/295 |
| 7,090,380 | B2 * | 8/2006 | Gerfers, III | 362/360 |
| 7,303,305 | B2 * | 12/2007 | Kennedy | 362/147 |
| 8,287,146 | B2 * | 10/2012 | Hysky | 362/234 |
| 8,459,824 | B1 * | 6/2013 | Esmailzadeh et al. | 362/147 |
| 8,490,743 | B2 * | 7/2013 | Schnitta | 181/205 |
| 8,607,925 | B2 * | 12/2013 | Gideonse | 181/293 |
| 2009/0183944 | A1 * | 7/2009 | Pellisari | 181/287 |
| 2011/0175533 | A1 * | 7/2011 | Holman et al. | 315/130 |
| 2012/0106138 | A1 * | 5/2012 | Mandy et al. | 362/147 |
| 2013/0148357 | A1 * | 6/2013 | Johnston et al. | 362/253 |

* cited by examiner

*Primary Examiner* — Peggy Neils
(74) *Attorney, Agent, or Firm* — H. Jay Spiegel

(57) ABSTRACT

Combination light diffusion with either sound diffusion or absorption is provided in a single lighting fixture, to provide uniform luminosity and sound control. The traditional flat light diffuser is replaced with a translucent acoustical element which either diffuses sound or absorbs the sound. The sound diffuser topology includes random surfaces, geometrical shapes, number theoretic diffusers or optimized rectilinear or curvilinear surfaces. The translucent sound absorber includes microperforated or microslit panels, as well as translucent fabrics and microperforated, translucent wood veneers.

15 Claims, 20 Drawing Sheets

Absorption

Reflection

Diffusion

COMBINATION LIGHT DIFFUSER AND ACOUSTICAL TREATMENT AND LISTENING ROOM INCLUDING SUCH FIXTURES

BACKGROUND OF THE INVENTION

The present invention relates to a combination light diffuser and acoustical treatment and listening room including such fixtures. Air diffusers provide uniform temperature and prevent cold and hot zones. Lighting diffusers uniformly illuminate a room removing optical glare and minimizing light and dark zones. Similarly, a sound diffuser uniformly distributes sound in a room, to provide ambiance, even coverage and removes acoustical glare caused by strong specular reflections. Sound can be controlled by absorption, reflection and diffusion. Sound is attenuated by absorption, redirected by reflection and uniformly distributed by diffusion. While the design of spaces used for speech has typically relied solely on absorption, an optimal design can only be achieved using an appropriate combination of each constituent.

Typical ceiling T-bar lighting units consist of an incandescent, fluorescent or LED light source with a flat or parabolic diffusing element. There are many applications, including classrooms, lecture halls, conference and meeting rooms where a ceiling lighting fixture that also provided sound diffusion or sound absorption would improve communication and speech intelligibility. The present invention solves this problem by teaching a novel approach by incorporating a sound diffusing or absorptive element at the face of the light source to simultaneously diffuse the light providing uniform illumination and sound control.

In the application of sound control acoustic treatments in the design of classrooms, training rooms, conference and meeting rooms, lecture halls, presentation rooms, or essentially any room where high speech intelligibility is required, the complete acoustical palette is considered. Typically the ceiling in a speech room consists of acoustical ceiling tile and lighting fixtures. Why is an absorptive ceiling not conducive to high intelligibility?

As is known, the ear/brain processor can fill in a substantial amount of missing information in music, but requires more detailed information for understanding speech. The speech power is delivered in the vowels (a, e, i, o, u and sometimes y) which are predominantly in the frequency range of 250 Hz to 500 Hz. The speech intelligibility is delivered in the consonants (b, c, d, f, h, j, k, l, m, n, p, q, s, t, v, w), which requires information in the 2,000 Hz to 4,000 Hz frequency range. People who suffer from noise induced hearing loss typically have a 4,000 Hz notch, which causes severe degradation of speech intelligibility.

This raises the question: Why would we want to absorb these important frequencies on the ceilings of speech rooms and prevent them from fusing with the direct sound, thereby making it softer and less intelligible? This appears to be the opposite of what is desirable.

Research has revealed the importance of early reflections and reverberation to intelligibility. There is a difference between hearing speech and understanding it. When early reflections arrive in a temporal window roughly 20-50 ms after the direct sound and roughly between 5 and 15 dB below the level of the direct sound, there is a process called temporal fusion in which the direct sound is fused with the early reflections making it louder and more intelligible. So one important design criterion for small rooms used for speech is to provide early reflections and to not absorb them!

Many of the problems that arise in poorly designed speech rooms stem from a low Signal to Noise Ratio. The signal consists of the direct sound and early reflections (between roughly 20-50 ms). The noise consists of reverberation, occupant noise, exterior noise intrusion and noisy MEP systems. Adults typically require 0 dB signal-to-noise ratios for high speech intelligibility when listening to simple and familiar speech material for short periods of time. An additional 2 dB is needed to compensate for neurological immaturity. An additional 5 dB is required to compensate for sensorineural and conductive hearing losses. An additional 5 dB is required for limited English proficiency and language disorders. An additional 3 dB is required to compensate for the effects of excessive reverberation. These additional requirements for speech rooms total 15 dB over that of normal adults, or a signal-to-noise ratio of +15 dB. Passive acoustics in the architecture can be employed to provide some of this needed gain. Most design approaches only try to reduce the noise and often simultaneously decrease the strength of the signal as well, by using only absorption. The result is no net improvement. Excess reverberation can also corrupt the purity of the speech signal and decrease intelligibility. So it is important to increase the signal, by (1) introducing diffuse ceiling reflection, and (2) decreasing all forms of noise, including reverberation. At the same time, ceiling illumination is also required, but it is often located in locations where acoustical treatments should optimally be positioned. Hence, there is a need for combining sound diffusion and lighting, as well as sound absorption and lighting to reduce the reverberation time. It would be advantageous to place luminous absorptive fixtures around the perimeter of the room, to complement centrally located luminous diffusers. It is with these thoughts in mind that the present invention was developed.

SUMMARY OF THE INVENTION

The present invention relates to a combination light diffuser and acoustical treatment and listening room including such fixtures. The present invention includes the following interrelated objects, aspects and features:

(1) In accordance with the teachings of the present invention, the optimal approach is to treat the ceiling by decreasing the noise and simultaneously increasing the signal by providing:

a) reflective areas surrounding the source to increase the apparent level;

b) absorptive areas around the perimeter of the ceiling to control the decay time;

c) useful, early, diffuse reflections from the center of the ceiling by the use of a combination light and sound diffusing ceiling fixture.

(2) FIGS. 1*a-c* illustrate the beneficial use of diffusion on the ceiling of speech rooms. Absorption (FIG. 1*a*) removes these beneficial reflections, reflection (FIG. 1*b*) redirects them, but only diffusion (FIG. 1*c*) can uniformly distribute them providing better coverage, cross-communication between participants, and improving intelligibility.

(3) In FIG. 2, an example of a concept design for a speech room is depicted consisting of a reflective front wall and ceiling above the presenter to amplify sound, even when the presenter turns away from the audience, absorptive ceiling perimeter and upper third of side and rear walls to control flutter echo and the decay time, combined light and sound diffusing ceiling over the center of the room, diffusing/absorptive surfaces on the mid third of the side and rear walls and reflective lower third of the side and rear walls.

(4) In FIG. 3, a typical conference room is shown with a light/sound diffusing central ceiling with a lowered absorptive soffit consisting of a combined lighting element with a translucent absorptive face around the perimeter of the room to control reverberation, along with traditional acoustical ceiling tile.

(5) Since the ceiling is an important acoustical design element and space for lighting, the sound diffusion and absorption can be competitive, so it is advantageous to be able to combine these elements in a single lighting fixture element.

(6) The uniformity of sound diffusion is specified by the ISO 17497-1 and ISO 17497-2 standards. The absorption efficiency can be specified by ISO 354, in the form of the random incidence absorption coefficient, or ISO 10534-2, in the form of the normal incidence absorption coefficient. The lighting photometrics of the combined lighting fixture and light/sound diffuser/sound absorber are specified by the Illuminating Engineering Society in an IES photometrics file. Diffusive and absorptive elements used in combination with the lighting source should have good acoustical performance and not just be ornamental structures.

(7) Elements to diffuse light uniformly may be fabricated from plastic or metal, in flat form, cells or parabolic egg crate formats. Sound diffusing surfaces were first introduced by Applicant in the early 1980s and are fabricated from wood, plastic, metal, concrete and glass reinforced gypsum. The present invention simultaneously provides uniform lighting and sound control, by replacing a traditional lighting diffuser, with either a translucent sound diffuser or a translucent sound absorber.

(8) Sound diffusing surfaces, fabricated from translucent plastics, are used to replace conventional light diffusing elements in lighting fixtures and simultaneously diffuse light and sound. The sound diffusing ability is derived from the topology of the sound diffuser. There are many topologies that can scatter sound, from random surfaces to optimally designed topologies based on mathematical number theory sequences or boundary element optimization techniques. The deeper the light/sound diffuser is, the lower the frequencies that are efficiently scattered. The present invention includes ways to combine light and sound diffusion in the same lighting fixture. The combined luminous diffuser facing can be fabricated by thermoforming, injection molding or any appropriate plastic molding technology that allows sufficient light transmission from the preferred embodiment of an LED light source. If the diffusive facing is flush with the ceiling plane, it can be covered with a translucent and acoustically transparent non-woven mat to allow the light/sound diffuser to match the acoustical veil used on surrounding acoustical ceiling tile, offering a luminous and sound diffusive ceiling tile.

(9) The present invention shows how to utilize translucent microperforated or microslit facings, which do not require porous absorption behind them, to simultaneously diffuse light and provide sound absorption. The larger the air cavity between the microperforated or microslit panel and the light source, the lower the frequency of efficient absorption. A non-woven mat can optionally be placed behind the microperf or microslit facing to improve sound absorption and also minimize light leaks through the openings. In addition, a translucent and acoustically transparent non-woven veil may be added in front of the microperf or microslit absorber to match existing acoustical ceiling tile, which are faced with similar mats, creating a luminous ceiling tile. These non-woven mats are made from randomly dispersed glass fibers, wet or dry laid, and bonded into a thin sheet. The combined luminous absorber facing can be fabricated by creating a microperforated or microslit translucent plastic panel, by mechanical punching, drilling or laser technology.

(10) The combined fixture is designed to fit into typical T-bar sizes of 2'×2', 2'×4' or 4'×4'. The light diffusing fixture with either a sound diffusing or sound absorbing facade can be flush with the suspension grid or project below the grid plane into the room.

It is a first object of the present invention to provide a combination light diffuser and acoustical treatment and listening room including such fixtures.

It is a further object of the present invention to replace a traditional flat lighting diffusive facing with a translucent sound diffusing facing.

It is a yet further object of the present invention that a sound diffusing face can consist of random, geometrical, number theoretic or shape optimized topologies satisfying the desired scattering and diffusion coefficients as determined by ISO 17497-1 and 2, respectively.

It is a still further object of the present invention that the diffusive topology can be fabricated by thermoforming, injection molding, solvent welding, etc. with materials complying with UL and ETL standards for lighting fixtures.

It is a yet further object of the present invention to incorporate such a combined fixture in a typical T-bar ceiling grid.

It is a still further object of the present invention to design such a fixture so the diffusive element lies in the plane of the T-bar ceiling or below it.

It is a yet further object of the present invention that when the diffusive facing is in the plane of the ceiling, it is covered with a translucent and acoustically transparent non-woven glass mat with the same design as surrounding acoustical ceiling tile, providing a luminous and diffusive acoustical ceiling tile that blends in with the surrounding ceiling.

It is a still further object of the present invention to design the depth of the diffusive element to extend to a desired low frequency to control speech and music.

It is a further object of the present invention to replace the traditional flat light diffusing element with a translucent microperforated or microslit facing to provide sound absorption.

It is a still further object of the present invention to use multiple layers of microperforated foil to improve the sound absorption, as needed.

It is a yet further object of the present invention to design such a fixture so the absorptive element lies in the plane of the T-bar ceiling or below it.

It is a still further object of the present invention to design the cavity depth between microperf or microslit facing and the lighting source to appropriately absorb in a frequency range desired for speech or music.

It is a yet further object of the present invention to provide a deeper cavity, where it is desired to treat lower frequencies.

It is a still further object of the present invention that for increased absorption, multiple spaced layers of a microperforated foil can be used, with preferred spacing of 2 inches or greater, with a typical foil thickness of 0.1 mm, hole diameter of 0.2 mm, and hole spacing of 2 mm, having roughly as many as 30,000 holes per square foot.

It is a yet further object of the present invention that the microslit panel is preferably approximately 2-5 mm thick with slots approximately 0.2 mm wide and 10 mm apart, the slits being linear or custom designed providing similar open area. The absorption frequency response will depend on the panel thickness, the slot width and the slot spacing and is designed to provide useful absorption for speech and music.

It is a still further object of the present invention to digitally print graphic images on the translucent microperf or microslit sound absorbing facing offering illuminated images.

It is a yet further object of the present invention to place a translucent non-woven matt directly behind a microperf or microslit facing to minimize light streaking and maximize sound absorption.

It is a still further object of the present invention to cover a microperforated or microslit surface with a translucent and acoustically transparent non-woven glass mat with the same design as surrounding acoustical ceiling tile, providing a luminous and absorptive acoustical ceiling tile that blends in with the surrounding ceiling.

It is a still further object of the present invention to cover a perforated, microperforated or microslit foil or panel with a microperforated translucent, thin wood veneer and suitable backer, having up to 30,000 holes per square foot, providing a luminous and absorptive glowing wood light fixture to match and complement surrounding absorptive wood ceiling elements. An optional non-woven mat may be placed behind the perforated, microperforated or microslit absorptive element to increase absorption and uniformly disperse the light source.

It is a yet further object of the present invention that the preferred lighting source shall be low voltage LED to provide energy savings, minimize heat loading and operational cost, and remove AC from the ceiling plenum.

These and other objects, aspects and features of the present invention will be better understood from the following detailed description of the preferred embodiment when read in conjunction with the appended drawing figures.

BRIEF DESCRIPTION OF THE DRAWINGS

FIG. 4L shows the fixture of FIGS. 4*i-k* with pin point LEDs visible through the non-woven mat and illuminated. When translucent microperf or microslit absorbers (FIG. 9) are installed below the non-woven mat, the LEDs are no longer visible.

FIG. 5*a*: Diffuser extends below the ceiling plane. FIG. 5*b*: Diffuser is above the ceiling plane spaced an appropriate distance from the LED, with an optional non-woven acoustical veil in front of it.

SPECIFIC DESCRIPTION OF THE PREFERRED EMBODIMENTS

Figure 1A:
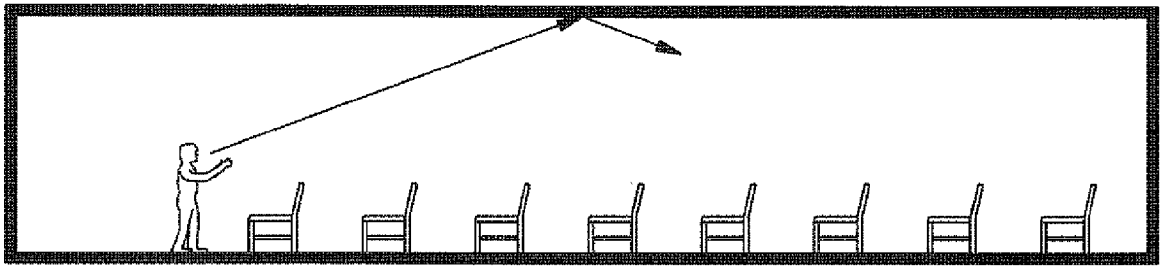
FIGS. 1*a-c* show how absorption removes the beneficial early reflections from the ceiling, reflection redirects them and diffusion uniformly distributes them for greater coverage and intelligibility.
Figure 1B:
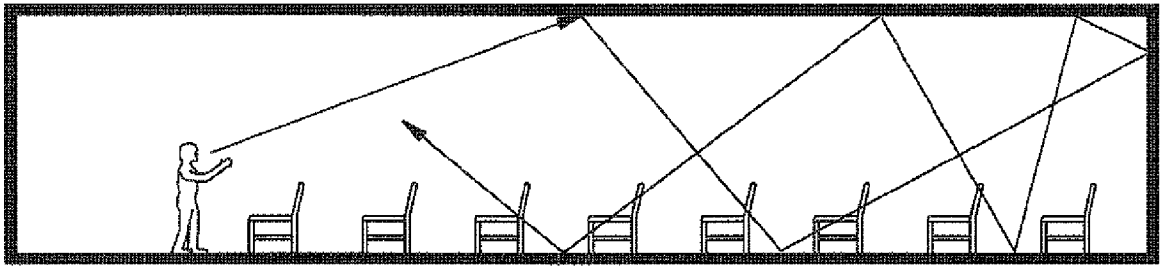
Figure 1C:
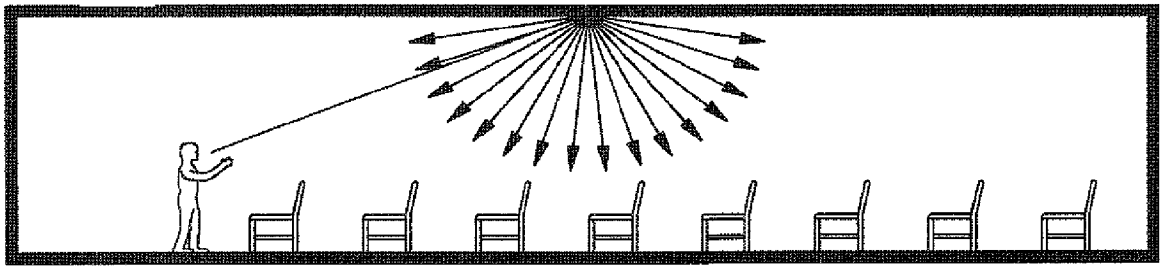

As explained above with reference to FIGS. 1*a-c*, there are distinct differences between absorption, reflection and diffusion. Absorptive ceiling treatments are designed to receive the incident sound waves and reflect only an extremely small percentage of the inbound waves. Reflective ceiling surfaces are designed to reflect as high a percentage of the inbound sound waves as is possible. By contrast, diffused sound resulting from diffusers incorporated into ceiling treatments shape the sound by reflecting it off an irregular surface so that it is scattered substantially uniformly. Applicant has found that an appropriate combination of diffused and absorbed sound is the perfect combination to manage the speech and other sounds that reach an individual's ear to optimize intelligibility.

Figure 2:
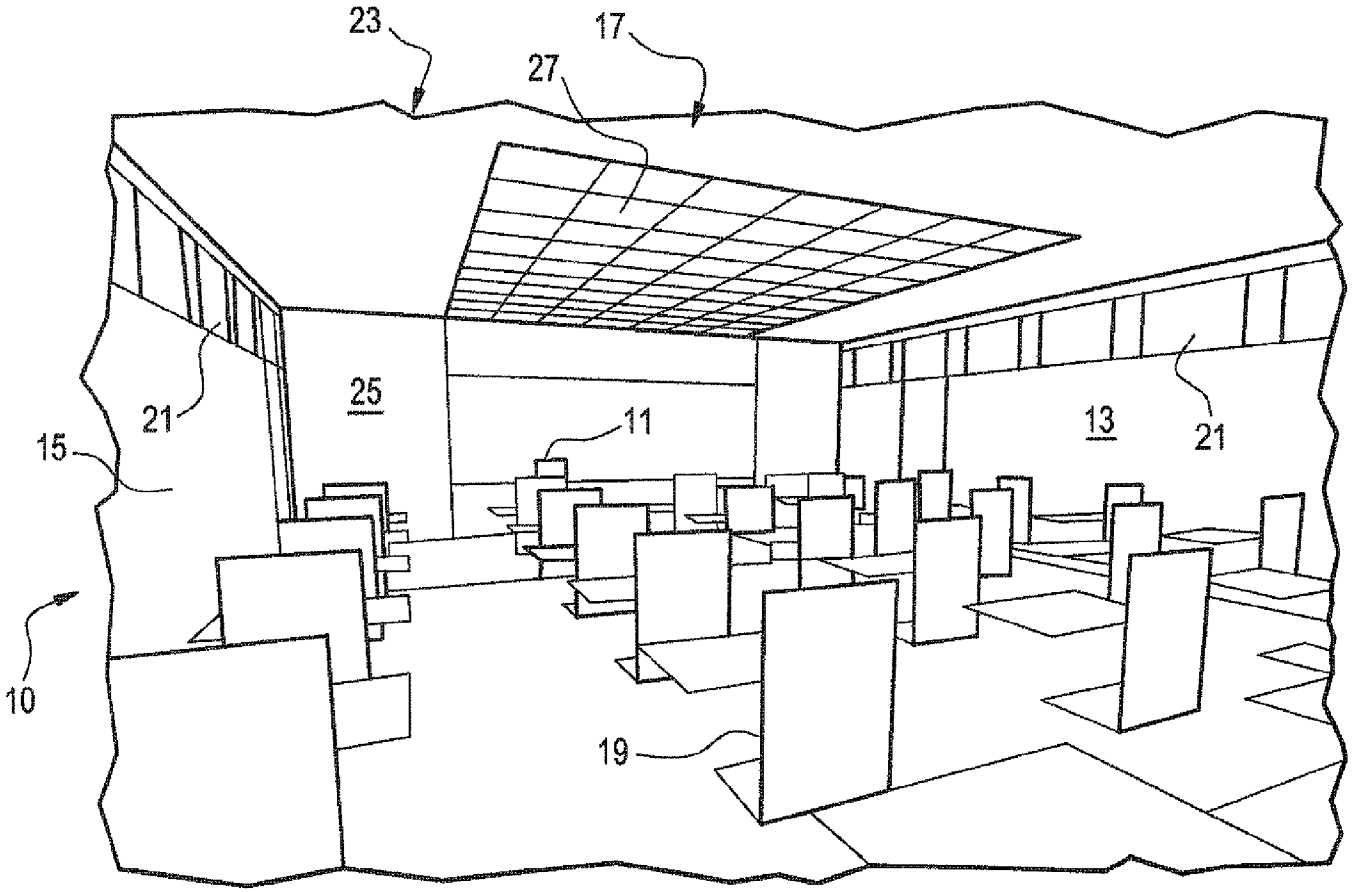
FIG. 2 shows a conceptual design for a speech room.

FIG. 2 shows an example of a conference room provided with acoustical treatments in accordance with the teachings of the present invention to enhance the ability of attendees to a speech or other presentation to understand what is being said at the podium. In FIG. 2, the room is generally designated by the reference numeral 10 and includes a podium 11, side walls 13 and 15, a ceiling 17, and a plurality of seats 19.

As seen, the walls are provided with absorptive upper portions that continue the absorptive periphery of the ceiling. The absorptive upper walls are designated by the reference numeral 21 while the absorptive ceiling periphery is designated by the reference numeral 23. The portions of the walls 13 and 15 below the absorptive portions 21 may be provided with diffusive surfaces to render uniform sound waves impinging upon them. Meanwhile, the front wall 25 is made of a reflective configuration as is the ceiling directly over a presenter standing at the podium 11 to more cleanly reflect his or her words toward the seats 9. The middle of the room 10 is provided with a ceiling configuration that is diffusive, designated by the reference numeral 27.

Figure 5A:
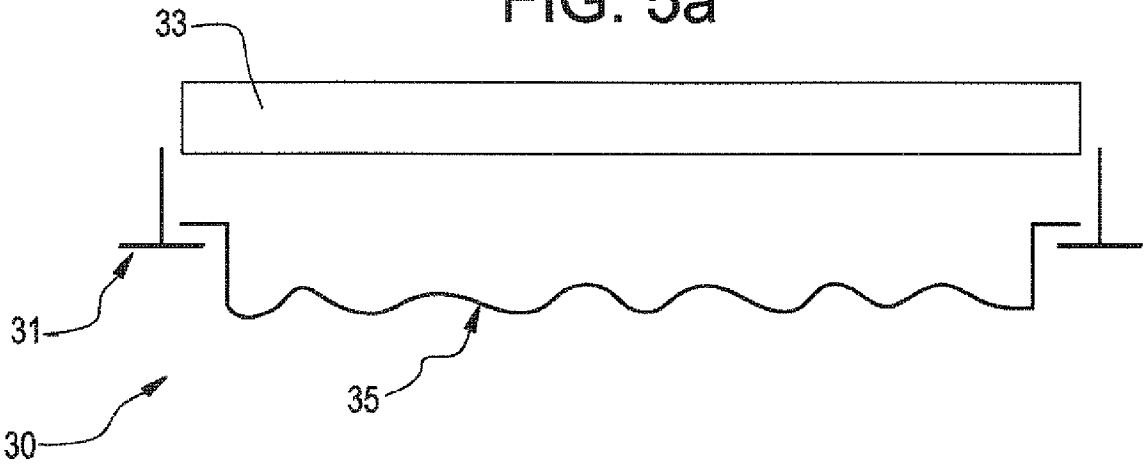
FIGS. 5*a* and 5*b* show exploded sections of typical 2'×2' LED combined lighting and acoustical fixture.
Figure 5B:
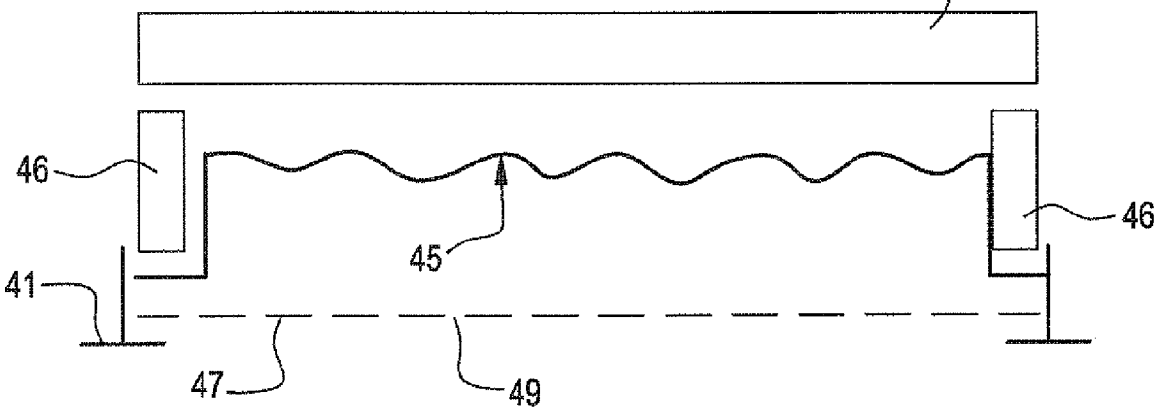

Of course, as is well known, the ceiling 17 typically includes a multiplicity of lighting fixtures to illuminate the room 10. The heart of the present invention is that of combining lighting fixtures with acoustical treatments. Thus, FIGS. 5*a* and 5*b* show two examples in which lighting fixtures are combined with sound diffusers. With reference to FIG. 5*a*, a fixture is designated by the reference numeral 30 and is shown with respect to the ceiling plane 31. The fixture includes illumination means 33, in the example shown, a series of light emitting diodes (LEDs). A sound diffuser 35 extends below the plane 31 of the ceiling and may take on any one of a number of configurations as will be explained in greater detail hereinbelow.

FIG. 5*b* shows a second example of a lighting fixture 40 which is recessed with respect to the ceiling plane 41. The lighting fixture 40 includes illumination means consisting of a plurality of LEDs 43 and a sound diffuser 45 recessed above the plane 41 of the ceiling. A non-woven acoustical veil 47 is provided at about the plane 41 to shield the lighting fixture 40. The veil 47 can be made of a non-woven glass mat. The veil is acoustically transparent. The sound diffusers 35 and 45 are made of a translucent material so that light from the respective light sources 33 and 43 can penetrate the diffuser and be visible within the room where the fixture 30 or 40 is mounted. The spacers 46 support the light source 43 at an appropriate distance to provide uniform illumination.

With reference to FIG. 6, a plurality of examples of sound diffusers usable in accordance with the fixtures 30 and 40 are shown. Thus, FIG. 6*a* shows perspective and side views of a bicubic contoured surface diffuser 50, and FIG. 6*b* shows top and side views of an offset pyramid-shaped diffuser 52. As particularly seen in the top view, the triangular surfaces 53, 54, 55 and 56 differ from one another in their respective shapes which are one way the diffuser element 52 acts to diffuse sound.

Figure 6A:
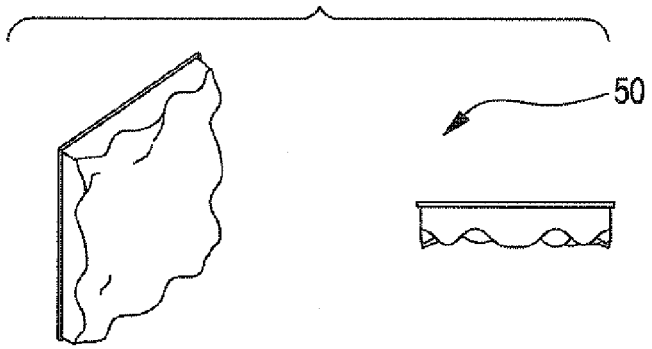
FIG. 6 shows examples of some tegular translucent diffusers: a) perspective and side views of a bicubic contoured surface; b) top and side views of offset pyramid shape; c) top and side views of a convex are with angled sides; d) perspective and side views of an egg crate-type surface with divided cells of different depth.
Figure 6B:
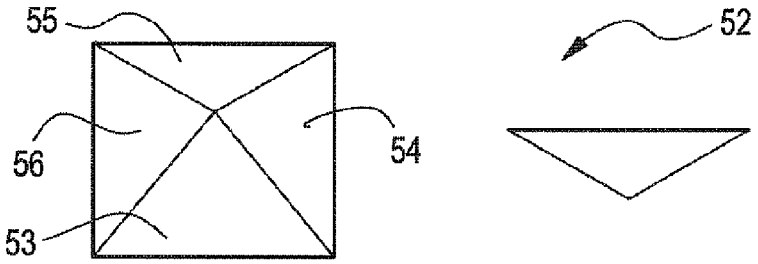
Figure 6C:
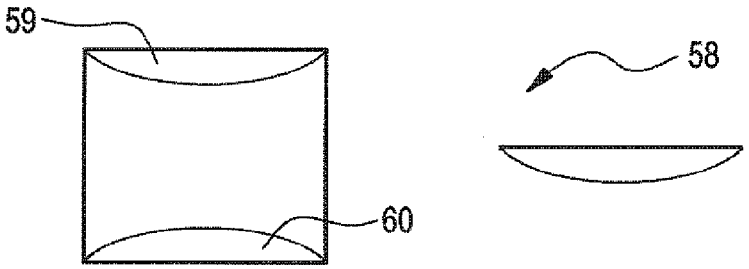
Figure 6D:
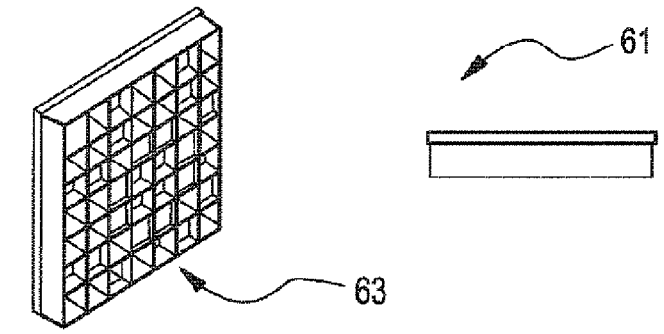

FIG. 6*c* shows top and side views of a convex diffuser 58 that has angled sides 59 and 60. FIG. 6*d* shows perspective and side views of an egg crate-type diffuser having divided cells as best seen in the perspective view identified by the reference numeral 63, with these cells having respective differing depths in accordance with a mathematical formula for enhancing the diffusive capabilities thereof.

Figure 7A:
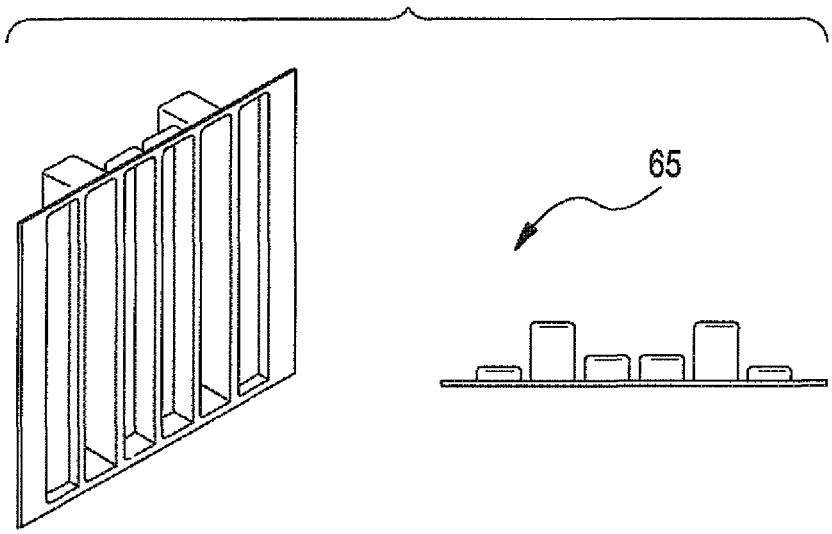
FIG. 7 shows examples of some diffusers which may lie in the plane of the ceiling: a) perspective and side views of number theoretic 1D diffuser with divided wells of optimal depths; and b) perspective and side views of number theoretic 2D diffuser with divided wells of optimal depths.

FIG. 7 shows examples of diffusers that may lie above the plane 41 of the ceiling in the embodiment of combined lighting fixture and diffuser depicted in FIG. 5*b*. Thus, with reference to FIG. 7*a*, perspective and side views of a number theoretic 1D diffuser 65 are shown. As shown, the diffuser 65 has a multiplicity of wells having differing depths calculated in accordance with a 1D number theory sequence.

Figure 7B:
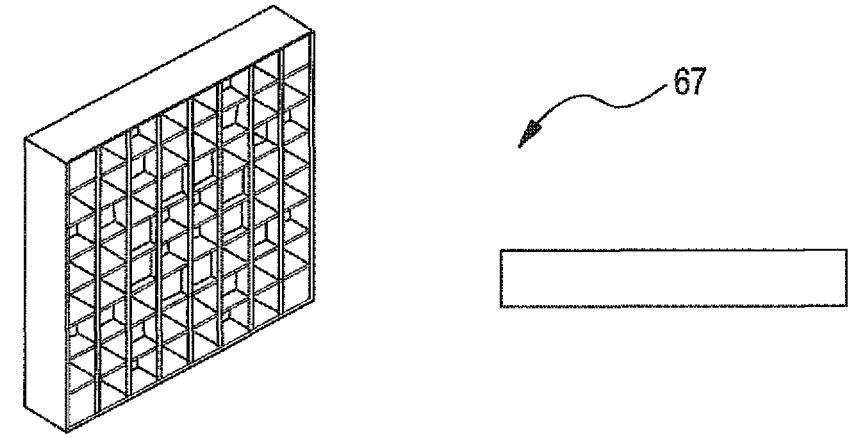

In FIG. 7*b*, a diffuser 67 is shown in perspective and a side view that is known as a 2D diffuser with a multiplicity of square-shaped wells of differing depths, with the depths calculated for optimal performance using a 2D number theory sequence.

Figure 8:
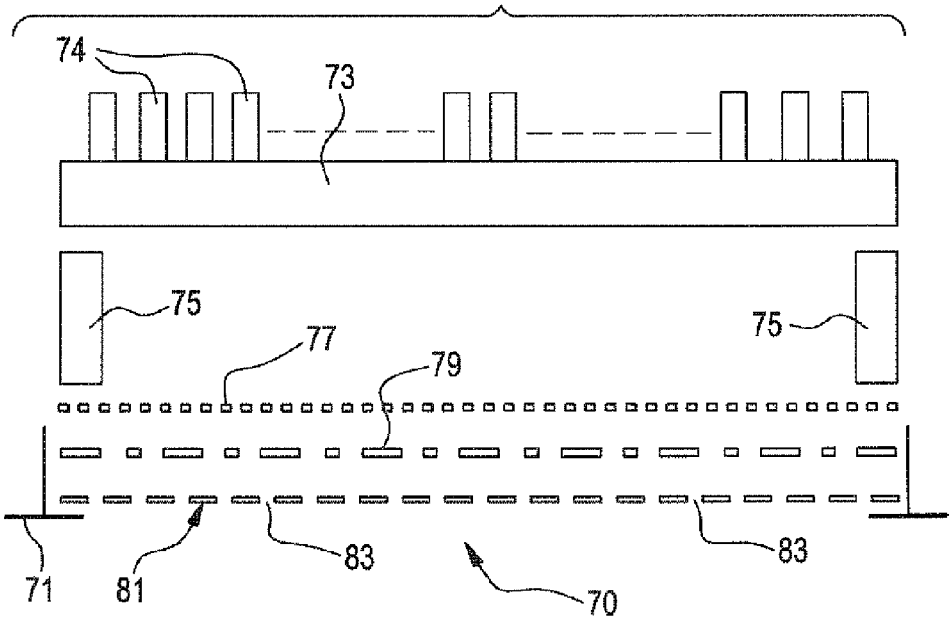
FIG. 8 shows an exploded section of a typical 2'×2' LED-combined lighting and acoustical fixture, utilizing microperf or microslit sound absorber and optional non-woven mat behind it and optional non-woven acoustical veil in front of it.

With reference to FIG. 8, another embodiment of a lighting fixture combined with an acoustical treatment is generally designated by the reference numeral 70 and is seen to be recessed above the plane 71 of the associated ceiling. The fixture 70 illuminates by virtue of a multiplicity of LEDs schematically shown and referred to with reference numeral 73. A non-woven mat 77 is provided beneath spacers 75 and beneath the non-woven mat 77 is a microperf or microslit sound absorber 79 shielded from view by a non-woven acoustically transparent veil 81 indicated by a dashed line. Reference numeral 73 also refers to the base of the fixture. Its back surface may be covered with longitudinal fins 74, seen from end view in the figure. These fins may convey heat away from the fixture since the fins are exposed to air circulation behind the fixture 70 from the associated HVAC system. Such fins 74 are equally applicable to each embodiment of fixture disclosed herein.

Figure 9B:
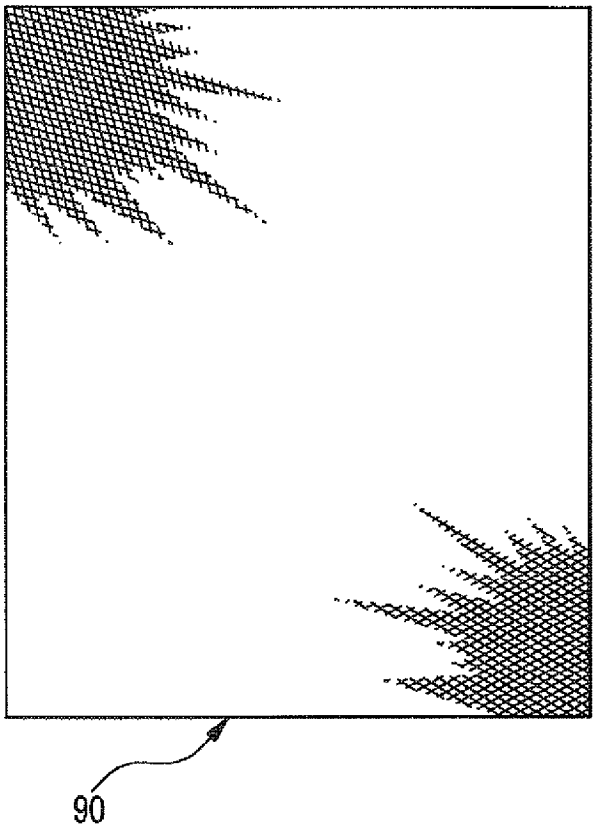
FIG. 9 shows an example (a) of a translucent microslit absorptive panel; and (b) an example of a microperforated translucent foil.
Figure 9A:
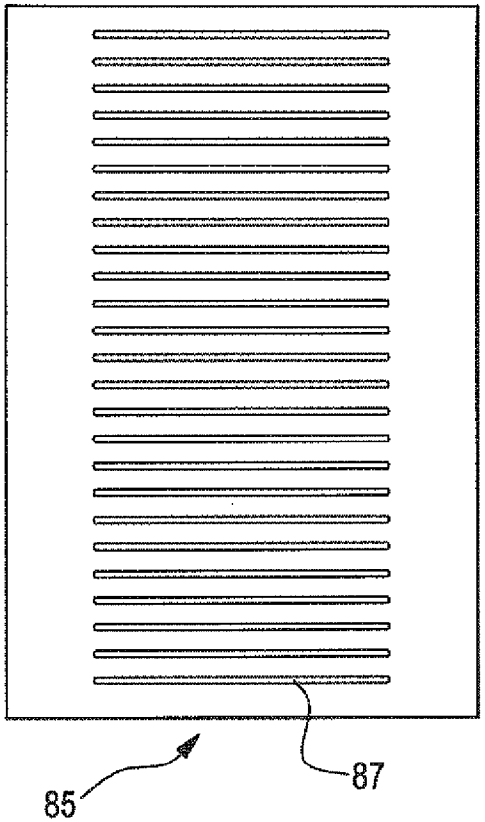

FIG. 9 shows two examples of absorptive panels usable in connection with the fixture 70 of FIG. 8. Thus, FIG. 9*a* shows a translucent microslit absorptive panel 85 having a plurality of slits 87, and FIG. 9*b* shows an example of a microperforated translucent foil absorptive panel 90 having a plurality of extremely small perforations not clearly visible in FIG. 9, but which allow sound penetration but deter sound reflection.

Figure 10:
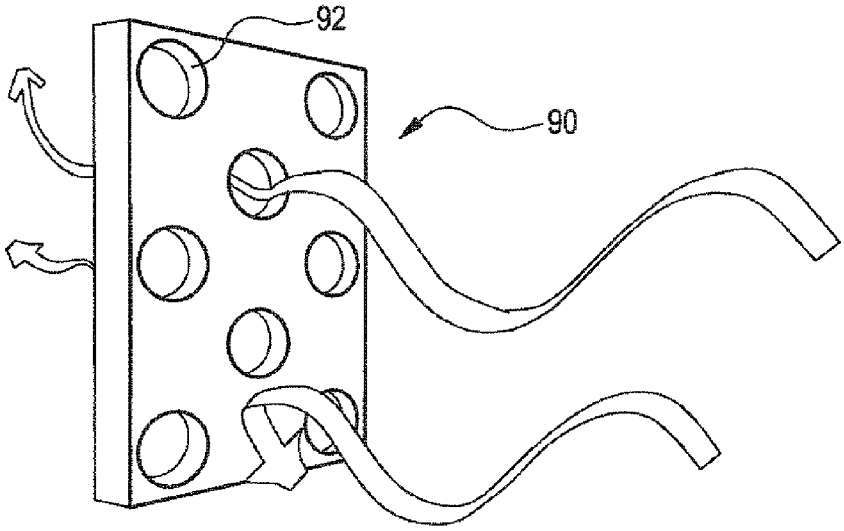
FIG. 10 shows an enlarged section of the microperforated translucent foil of FIG. 9*b* showing the microperforations and a description of how it works by converting sound energy into heat energy through viscous losses in the microperforations.

FIG. 10 shows an enlarged section of the panel 90 so that the microperforations 92 are visible and describes the absorption mechanism which converts sound energy to heat energy through viscous losses in the microperforations. This same absorption mechanism also applies to microslit absorbers.

FIG. 4 shows examples of a translucent panel that also may incorporate diffusive properties and may be utilized in connection with the embodiments of combination fixture 30 or 40 depicted in FIG. 5.

With reference, now, to FIGS. 4*a*-4L a description will be made of a variety of embodiments of lighting fixtures incorporating the teachings of the present invention.

Figure 4A:
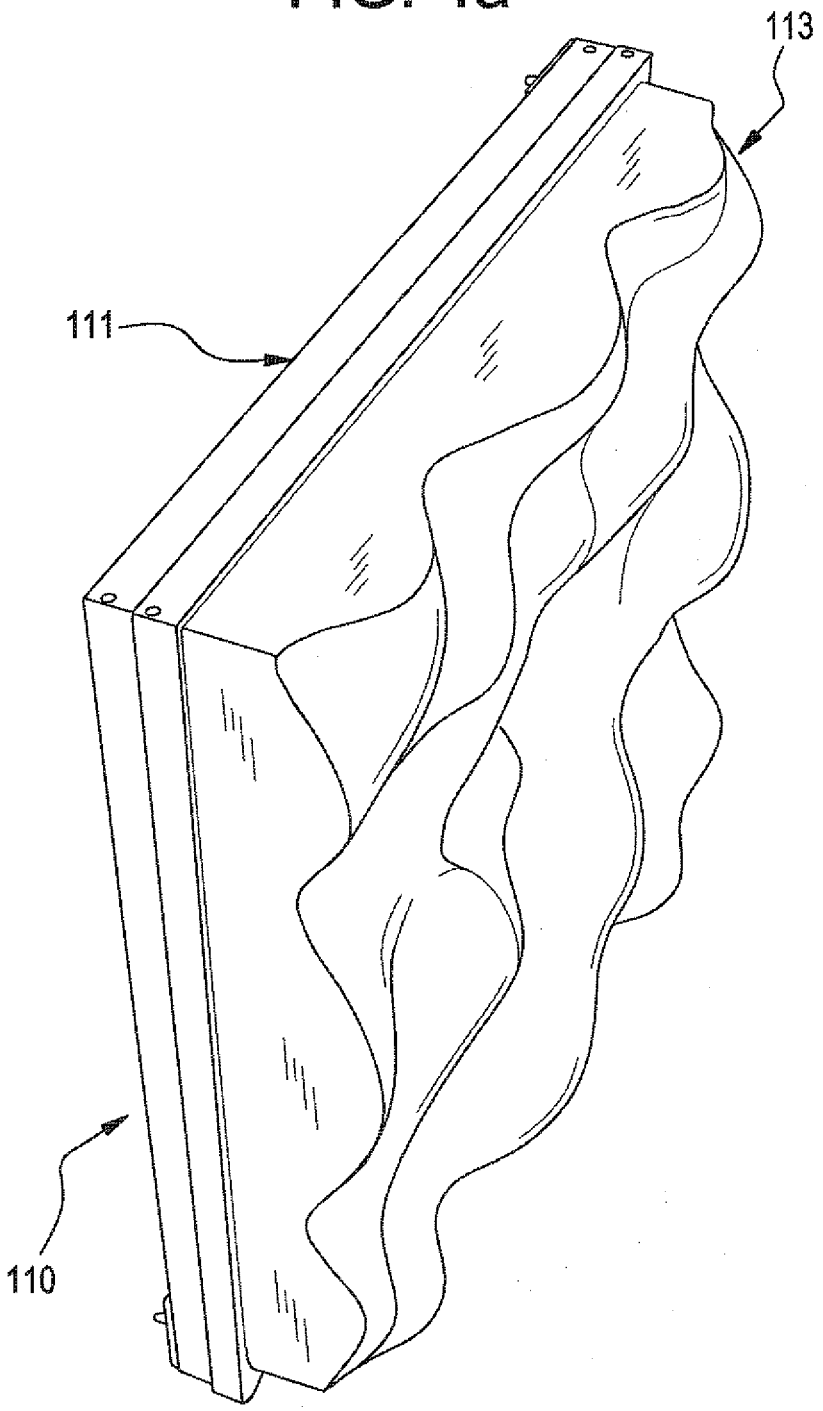
FIG. 4*a* shows a front isometric image of a diffusive 2'×2' lay-in fixture, which projects below the plane of the T-bar ceiling tile, illustrated in FIGS. 5*a* and 6*a*.
Figure 4B:
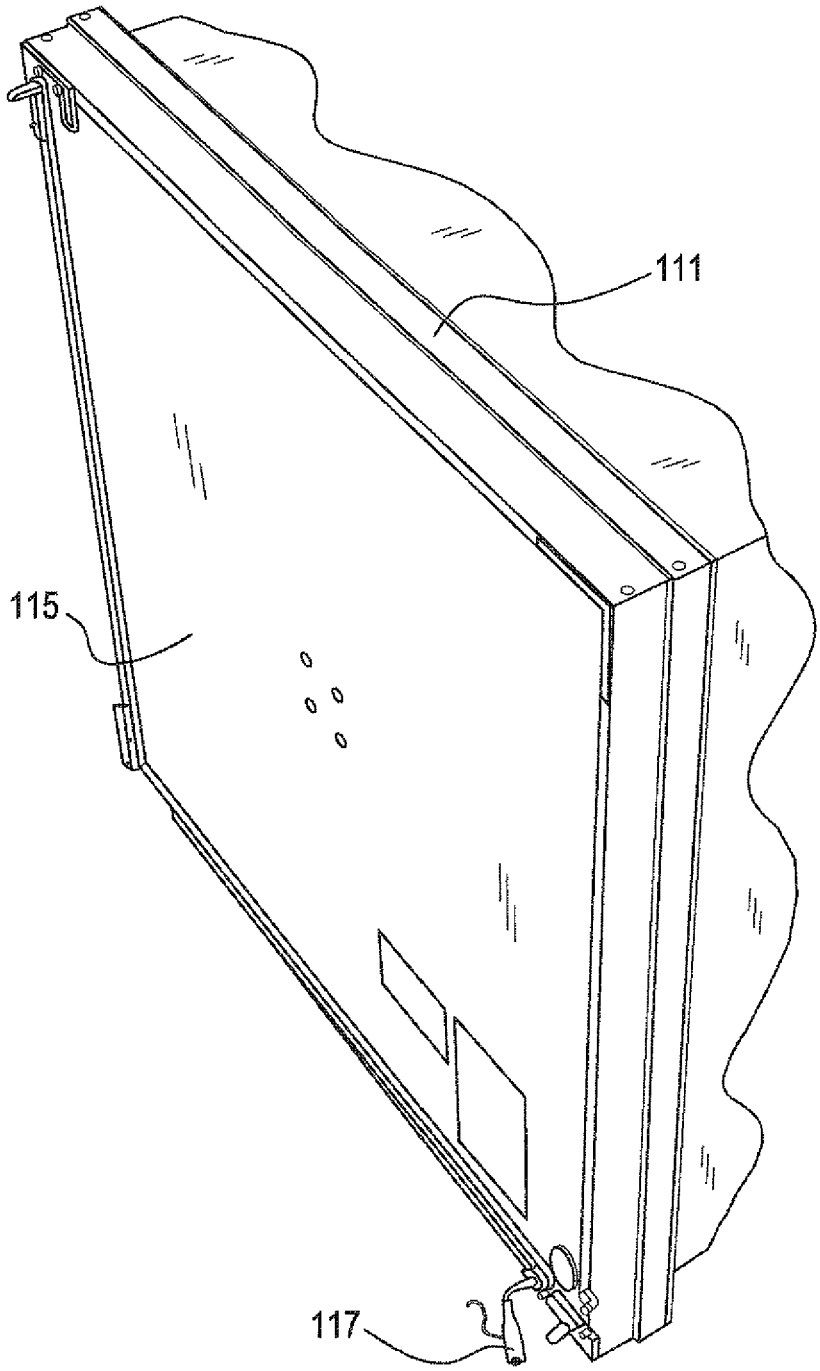
FIG. 4*b* shows a rear isometric image of the diffusive 2'×2' lay-in ceiling fixture of FIG. 4*a*.
Figure 4C:
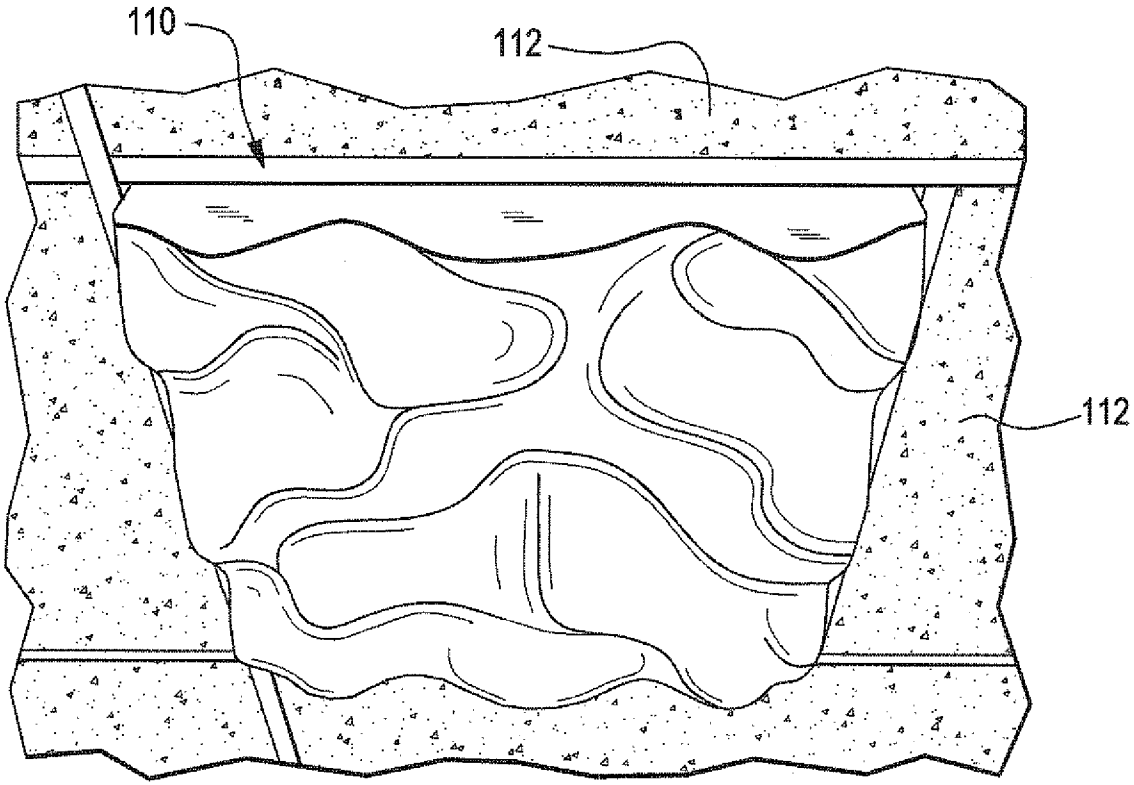
FIG. 4*c* shows an image of a non-illuminated diffusive ceiling fixture in a 2'×2' T-bar grid surrounded by conventional ceiling tile.
Figure 4D:
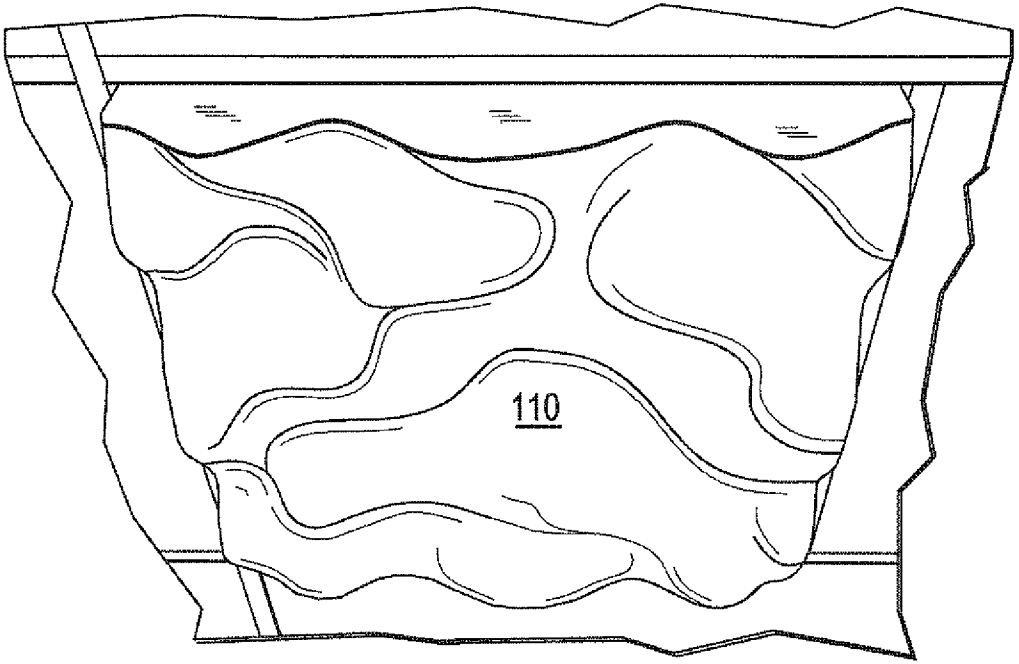
FIG. 4*d* shows an image of the diffusive ceiling fixture in a 2'×2' T-bar grid of FIG. 4*c* surrounded by conventional ceiling tile and illuminated.

With reference, first, to FIGS. 4*a*-*d*, a first example of a lighting fixture is shown, generally designated by the reference numeral 110. The fixture 110 includes a frame 111 generally rectangular in configuration, and a translucent lens 113 is designed, in a preferred mode of installation, to hang below the plane of a T-bar ceiling tile configuration as illustrated in FIGS. 5*a* and 6*a*. The translucent lens 113 has a surface configuration best described as a contoured surface specifically designed to receive incident sound and deflect it into the room below in a uniform pattern of sound waves. FIG. 4*b* shows that behind the frame is a rear wall 115 that is relatively flat and facilitates mounting within a recess in a ceiling. An electrical conductor 117 connects to a source of power to facilitate illuminating the fixture 110. FIG. 4*c* shows the fixture 110 as mounted within a grouping of ceiling tiles 112 and facing directly downwardly. FIG. 4*d* shows the lighting fixture 110 in which the illumination means contained therein is activated, whereby light easily shines through the translucent diffuser and the diffuser performs its diffusing purpose. The diffuser of FIGS. 4*a*-*d* is of the 2D variety having a two dimensional pattern of diffusing surfaces designed using multi-dimensional shape optimization techniques as understood by those of ordinary skill in the art.

Figure 4E:
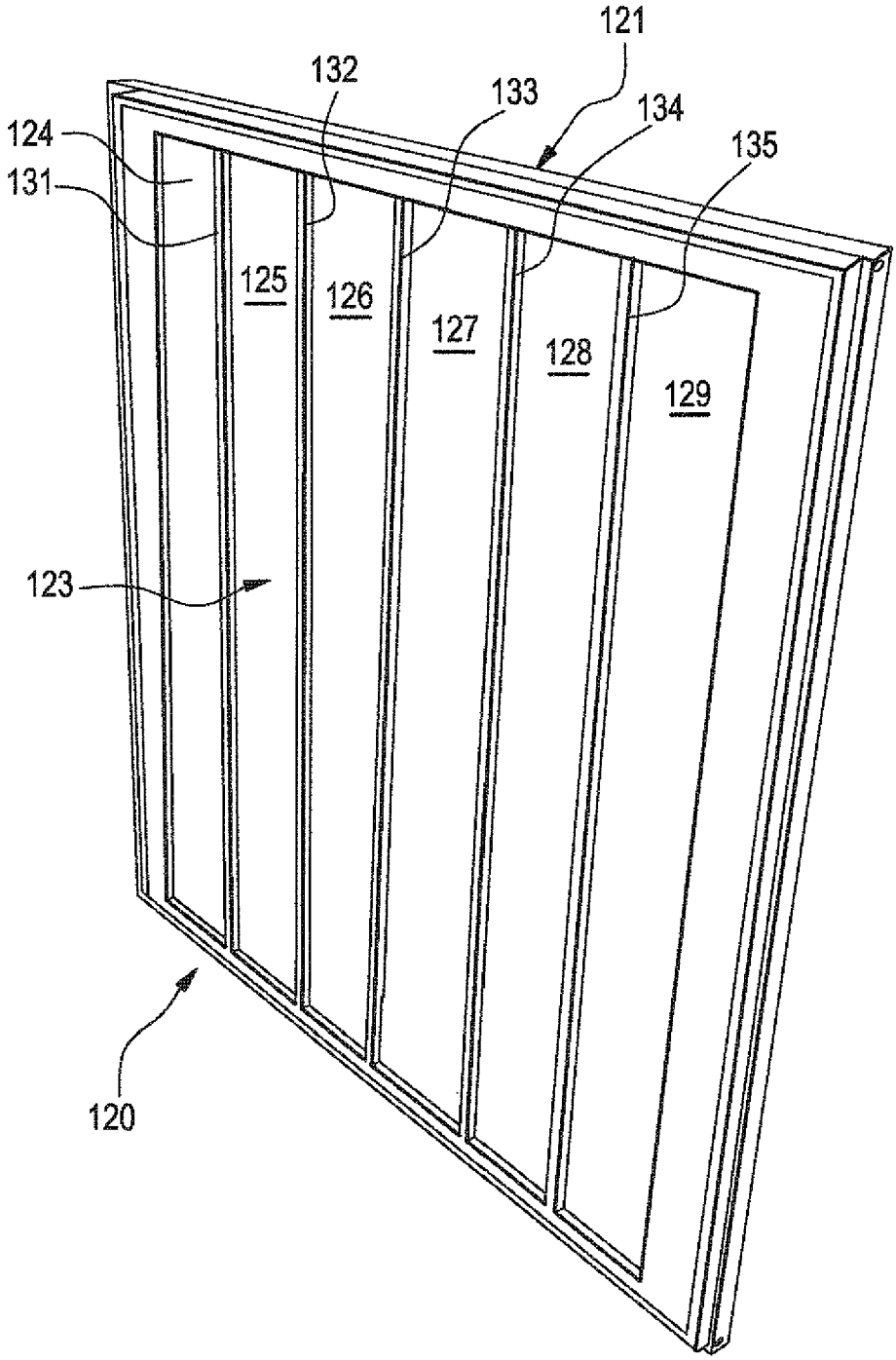
FIG. 4*e* shows a front view of a 1D quadratic residue diffusive fixture with a non-woven mat fascia, as also depicted in FIG. 7*a*.
Figure 4F:
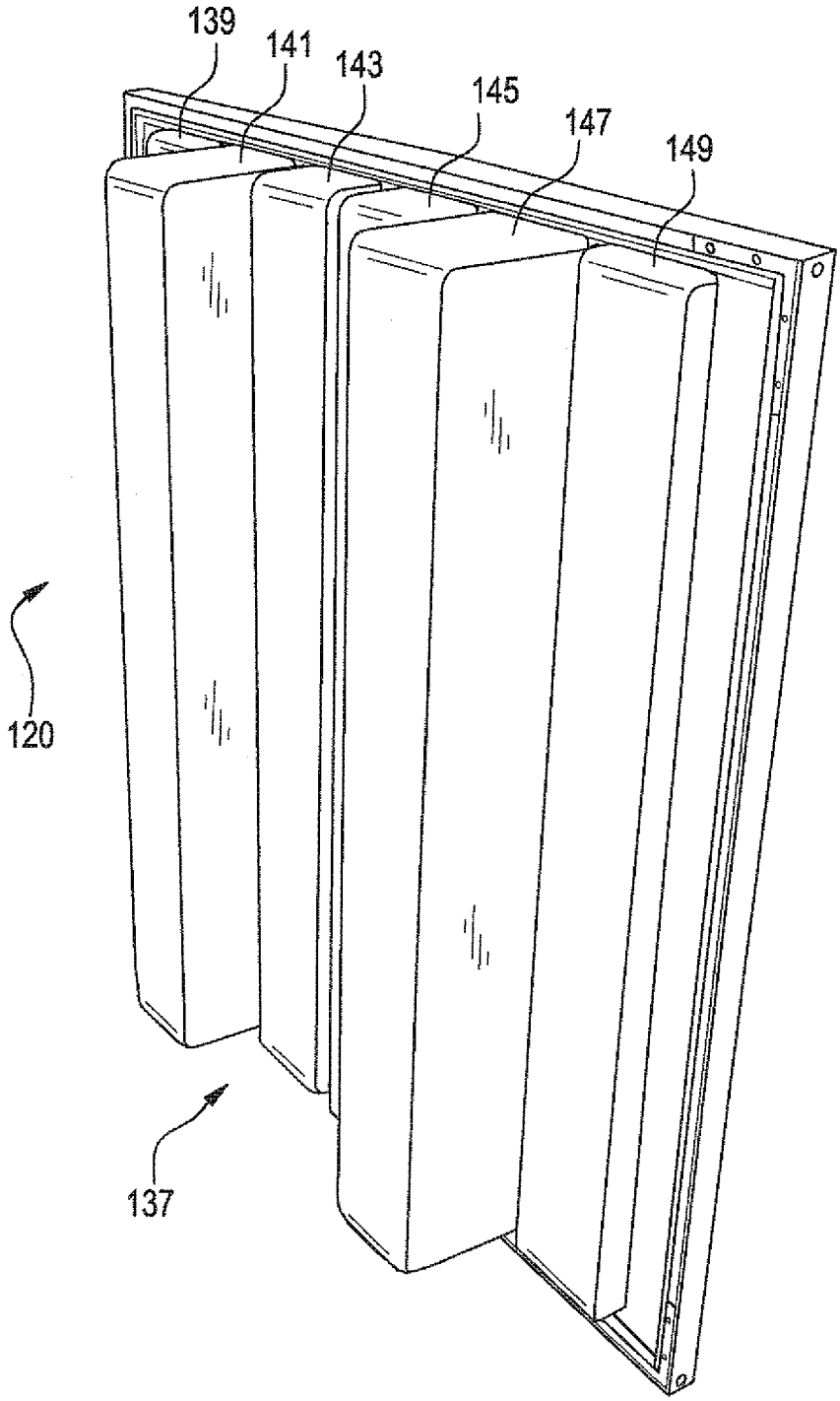
FIG. 4*f* shows a rear view of the diffusive fixture of FIG. 4*e*.
Figure 4G:
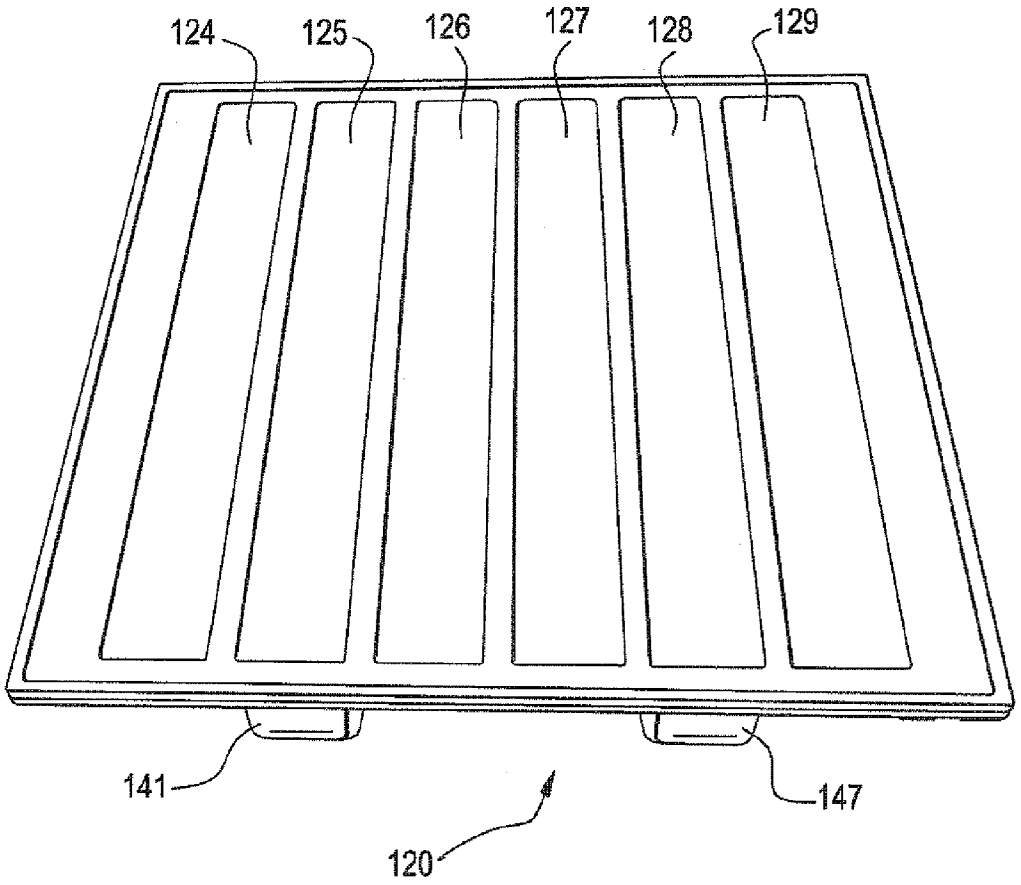
FIG. 4*g* shows a front view of the diffusive fixture of FIG. 4*e* with a non-woven mat fascia, which mounts in the plane of a T-bar grid. The dividers illustrated in FIG. 7*a* are covered, and the fixture is not illuminated.
Figure 4H:
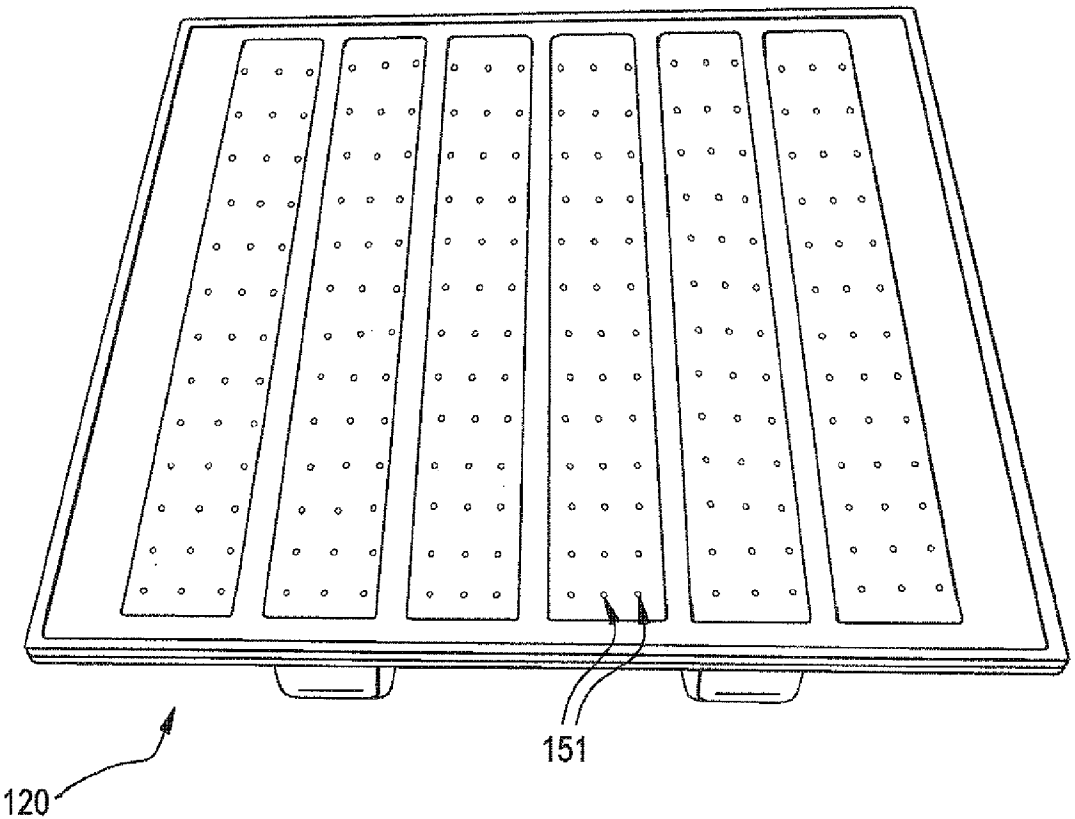
FIG. 4*h* shows the fixture of FIGS. 4*c* and 4*g*, with pin point LEDs placed at the bottom of the wells, visible, and illuminated.
Figure 4I:
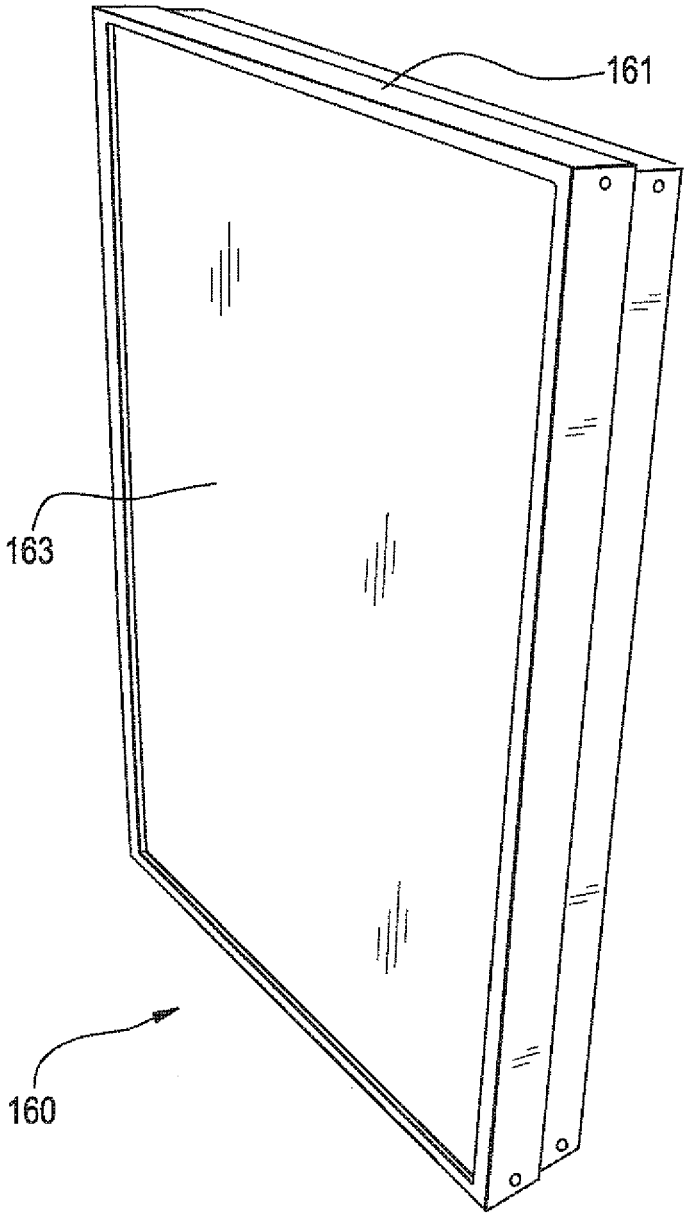
FIG. 4*i* shows a front view of an absorptive fixture with a non-woven mat fascia as illustrated in FIG. 8.

With reference, now, to FIGS. 4*e*-*h*, an example of a fixture 120 is illustrated which includes a 1D-type diffuser incorporated therein. With reference to FIG. 4*e*, the diffuser 120 includes a peripheral frame 121 and a translucent lens 123 that includes a plurality of regions 124, 125, 126, 127, 128 and 129 that are separated from one another by a multiplicity of respective bands 131, 132, 133, 134 and 135. The regions 124-129 are actually depicted on a covering that has, therebeneath, a series of wells that are created in accordance with an appropriate 1D mathematical number theory sequence formula. This is better understood from FIG. 4*f* which shows the rear 137 of the fixture 120 and shows the outer enclosing walls of a plurality of wells 139, 141, 143, 145, 147 and 149 corresponding to the reference numerals 124-129, respectively. FIG. 4*g* shows the fixture 120 tipped at an angle so that although the front is prominent, two of the rear walls of the wells 141 and 147 are also visible. FIG. 4*h* is a view similar to FIG. 4*g*, the distinction being that in FIG. 4*h* illumination from a multiplicity of LEDs 151 is clearly visible.

Figure 4J:
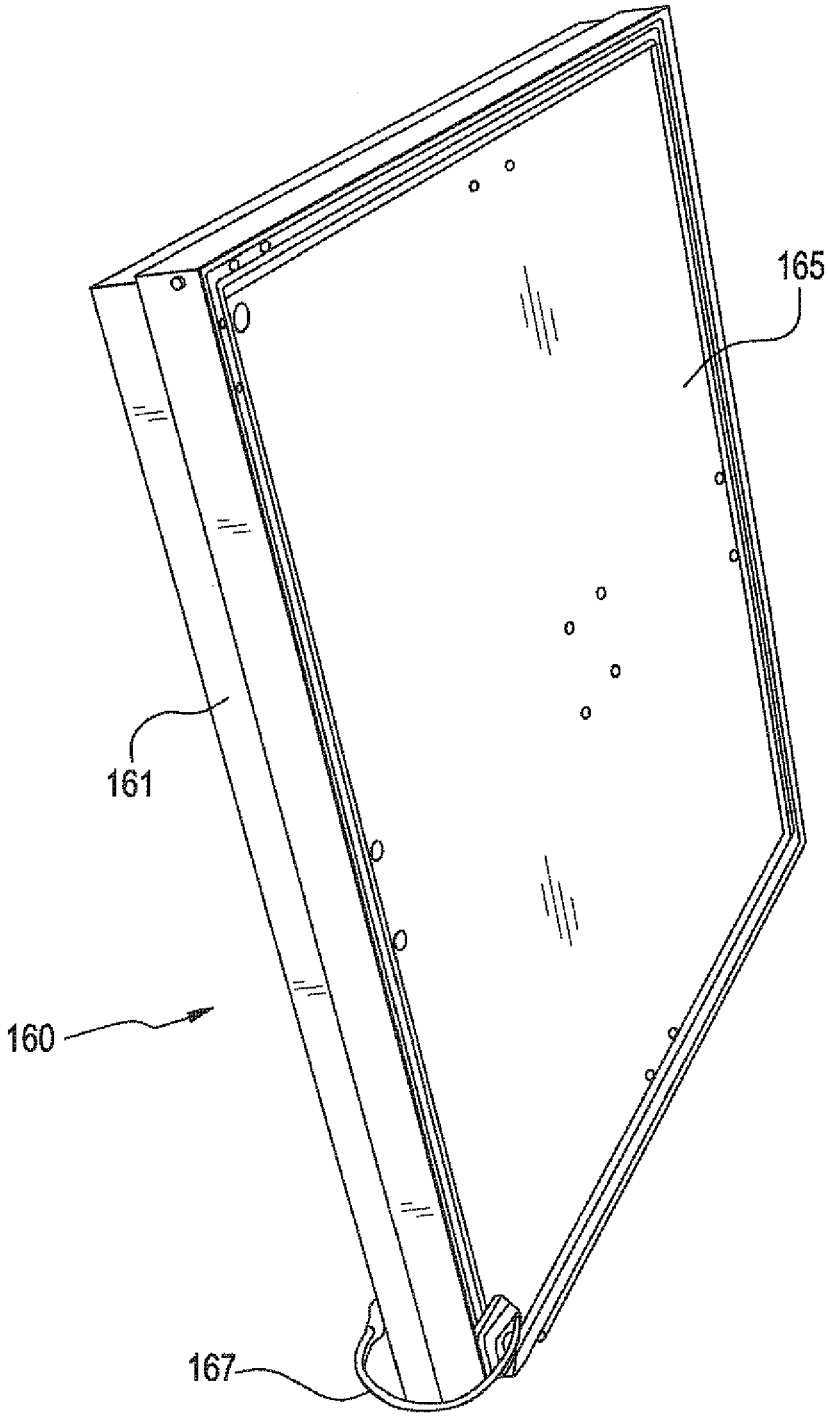
FIG. 4*j* shows a rear view of the fixture of FIG. 4*i*.

FIG. 4*i*-L show views of a lighting fixture 160 that includes an absorptive fascia. The fixture 160 includes a frame 161 that is generally rectangular and the fascia is preferably a non-woven mat 163 that is seen to cover the entirety of the face of the fixture 160. FIG. 4*j* shows the rear of the fixture 160 still showing the frame 161 and a flat back surface 165 as well as the electrical conductor 167 that facilitates connection of the light source therein to a source of electrical power.

Figure 4K:
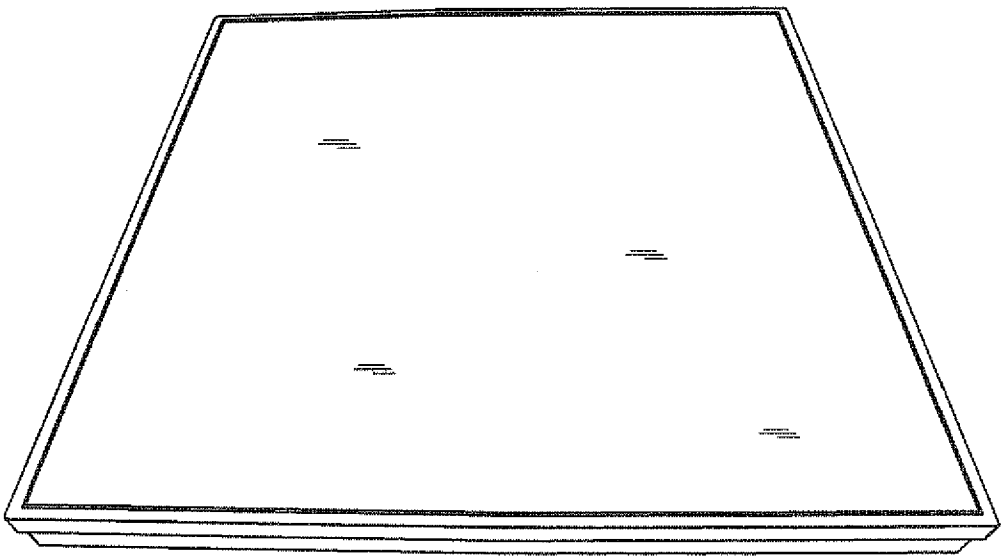
FIG. 4*k* shows a front perspective view of the fixture of FIGS. 4*i-j* as mounted in the plane of a T-bar grid.
Figure 4I:
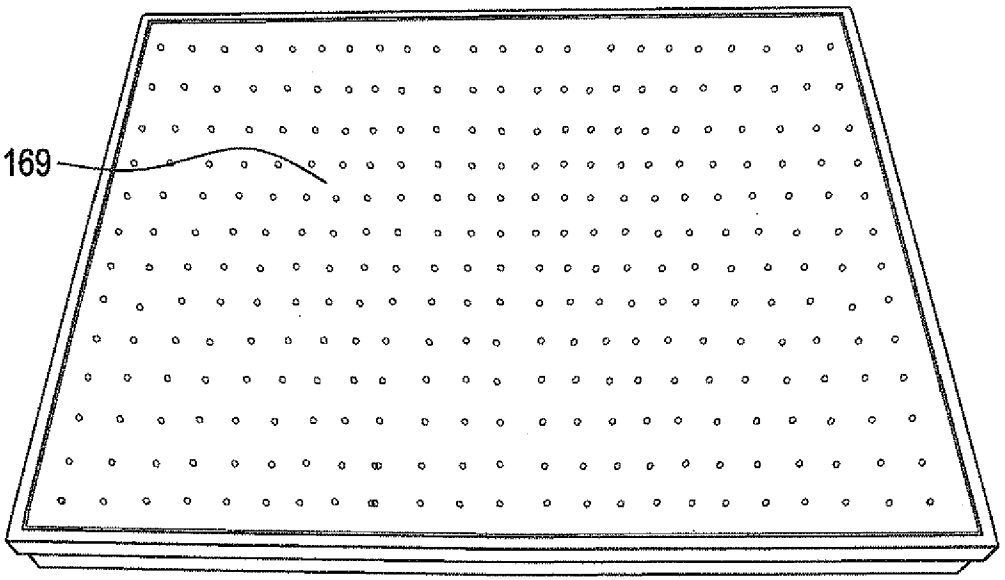

FIG. 4*k* shows a view of the fixture that should be compared to FIG. 4L because in FIG. 4L the illumination means consisting of a plurality of LEDs 169 is visible through the fascia 163. If translucent microperfs or microslit absorbers are installed below the fascia 163, the LEDs are no longer visible as individual points of light but, rather, the fixture merely glows with illumination.

Figure 3A:
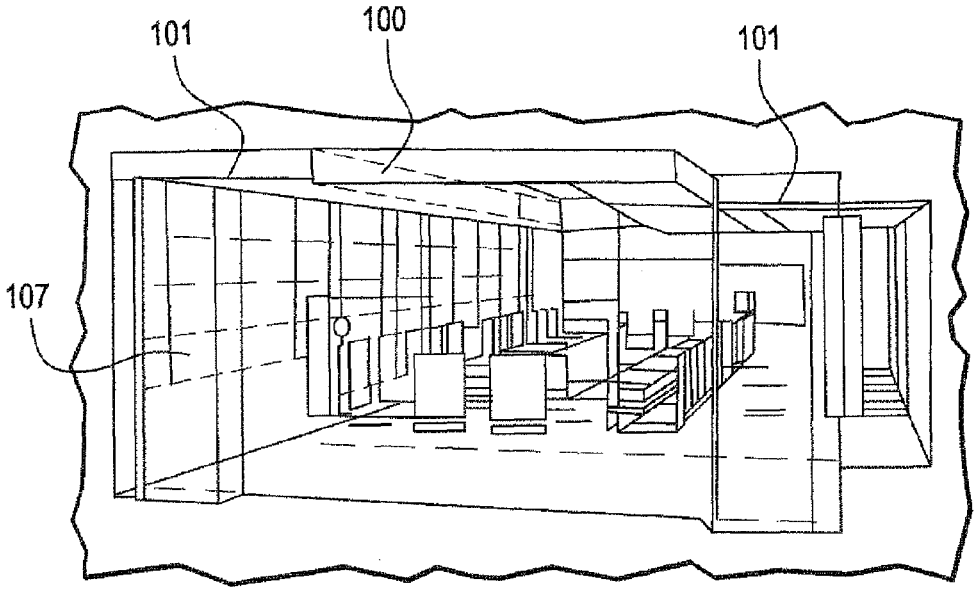
FIG. 3: Left (3*a*) shows a conference room having combined light/sound diffusing central ceiling and absorptive soffit, and right (3*b*) shows a conference room having light/sound diffusive ceiling with lowered absorptive soffit to control reverberation time.
Figure 3B:
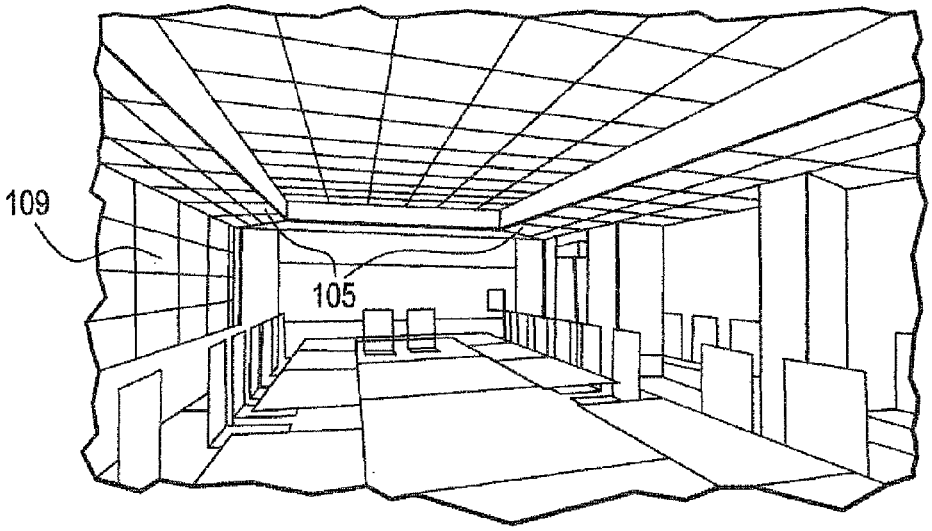

FIG. 3 shows further examples of a conference room that includes concepts in accordance with the teachings of the present invention. In FIG. 3*a*, what is visible is a central ceiling portion 100 that is recessed with respect to surrounding absorptive areas 101. The central section includes lighting fixtures combined with diffusive elements such as illustrated in FIG. 5. In fact, the fixtures 100 are analogous to the recessed fixture illustrated in FIG. 5*b* and designated by the reference numeral 40. By contrast, in FIG. 3*b*, the absorptive areas 105 are located in a lowered absorptive soffit for the purpose of controlling reverberation time. Similarly to FIG. 2, the walls 107 of the conference room depicted in FIG. 3*a* are diffusive. The same is true of the walls 109 in the conference room of FIG. 3*b*.

The preferred embodiment of the combined light and sound diffuser consists of an LED lighting fixture, typically 2'×2', with the conventional light diffuser replaced with a translucent sound diffusing surface, that satisfies the IES photometric data and the sound scattering and diffusion data as specified by ISO 17497-1 and ISO 17497-2. See FIG. 5.

In the embodiments of FIG. 4, a typical embodiment of a 2'×2' translucent diffuser backlight is shown and combines with an LED lighting element suitable for use in a 2'×2' lay-in T-bar ceiling grid.

The preferred embodiment of the combined light and sound absorber (FIG. 8) consists of an LED lighting fixture 73, typically 2'×2', with the conventional light diffuser replaced with a translucent microperf or microslit sound absorbing surface 79, that satisfies the IES photometric data and the sound absorption data as specified by ISO 354 or ISO 10534-2. There are several options using the translucent microperf or microslit sound absorber. In FIG. 8, shown are the LED 73 and the microperf or microslit translucent sound absorber 79. To improve absorption a translucent non-woven mat 77 can be applied to the rear of the absorber. To provide a fascia matching adjacent conventional ceiling tile, a non-woven acoustical veil 81 can be placed in front of the absorber. A spacer 75 is used to position the LED surface an appropriate distance from the absorbing fascia to provide uniform illumination.

While the light source in FIGS. 5 and 8 is shown as LEDs, of course, the light source can also be incandescent, fluorescent, or any other light source. The preferred light source is LEDs due to their low heat, low power consumption, and longevity. As is typical in room design, the lighting characteristics or quality are characterized by the Illumination Engineering Society (IES).

In the embodiments of FIG. 5 in which a diffuser is combined with illumination means, the diffusing fascia can consist of any topology which scatters sound. This may include random surfaces, geometrical surfaces, number theoretic surfaces, and optimized surfaces. Preferably, the sound diffusing surface is based upon a mathematical number theory sequence or boundary element optimization techniques. Sound diffusing quality is defined according to ISO 17497-1 and -2. As explained in FIGS. 5*a* and 5*b*, the sound diffusing fascia can be either flush or can project into the room below the plane of the ceiling.

Applicant has found that the deeper the sound diffusing element, the more optimal the low frequency response.

The teachings of the present invention are particularly advantageous in speech rooms and conference rooms to provide uniform illumination and sound coverage. In the preferred embodiments of rooms in accordance with the teachings of the present invention, the light fixtures combined with diffusers are located in the ceiling in a central area of the room to uniformly enhance communication and intelligibility between the speaker and the audience, the audience and speaker, and between respective audience members. The intent of the combined light/sound diffuser is to increase the signal to noise ratio of speech to thereby enhance speech intelligibility by providing early reflections which are fused by the auditory system in a louder and more intelligible signal. Sound absorbing elements are preferably employed around the perimeter of the room both in the ceiling and at the upper portions of the peripheral walls to control and limit reverberation.

The preferred embodiment for sound absorbing surfaces in accordance with the teachings of the present invention is based upon either microperforated or microslit technology. The sound absorbing quality and characteristics are preferably defined in accordance with ISO 354 or ISO 10534-2. To improve absorption, in the preferred embodiments of the present invention, a non-woven mat may be placed behind or in front of a microperforated or microslit element.

Decorative veils may be employed to match adjacent acoustical ceiling.

To increase sound absorption in the embodiments in which a sound absorber is incorporated into a lighting fixture, multiple layers of microperforated foil spaced apart by at least 2 inches in the vertical direction may be employed. The greater the cavity or spacing between the LEDs or other light sources and the acoustical treatments, the greater the low frequency response.

Hereinabove, the present invention has been disclosed in terms of certain kinds of room spaces to which it may be advantageously applicable. Applicant notes that the present invention including configurations of illumination means combined with acoustic treatments as well as other acoustic treatments in combination can be used in any room where music audition is important, including individual music rehearsal spaces, band rooms, choir rooms, distance learning rooms, recording in broadcast studios, rooms where plays and musicals are rehearsed and performed and any other possible room space. In such spaces, the dual functionality of the present invention, combining illumination with acoustical treatments simplifies design and aesthetics while also providing necessary acoustical control and modification.

Accordingly, an invention has been disclosed in terms of preferred embodiments that fulfill each and every one of the objects of the invention as set forth hereinabove, and provide new and useful combination light diffuser and acoustical treatment devices as well as listening rooms of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A lighting fixture, comprising:

a) a base mountable within a room space;

b) a source of illumination mounted in said base;

c) a translucent lens covering said source of illumination, whereby when said source of illumination is activated, light is visible through said lens; and d) said lens having an outwardly visible sound impervious surface exposed to said room space, said outwardly visible surface having a surface configuration comprising a self-contained sound diffusor.

2. The lighting fixture of claim 1, wherein said base is rectangular.

3. The lighting fixture of claim 1, wherein said base is surrounded by a ceiling of said room space.

4. The lighting fixture of claim 3, wherein said lens is recessed above said ceiling.

5. The lighting fixture of claim 3, wherein said lens extends below said ceiling.

6. The lighting fixture of claim 1, wherein said source of illumination comprises a plurality of LEDs.

7. The lighting fixture of claim 1, wherein said surface configuration comprises a diffusor including a plurality of elongated divided or non-divided wells having respective depths determined by an appropriate number theory sequence formula or boundary element optimization techniques.

8. The lighting fixture of claim 1, wherein said surface configuration comprises a diffusor including a plurality of rectangular wells having respective depths determined by an appropriate number theory sequence formula.

9. The lighting fixture of claim 1, wherein said surface configuration comprises a diffusor formed from a geometrical shape chosen from the group consisting of off-set pyramids, convex and cubic spline shapes.

10. The lighting fixture of claim 1, wherein said surface configuration comprises a diffusor designed using multi-dimensional optimization techniques, whereby said surface configuration is chosen from the group consisting of bicubic meshes and randomized surfaces.

11. The lighting fixture of claim 4, further including a spacer between said source of illumination and said lens.

12. The lighting fixture of claim 1, wherein said base has a rear surface covered with heat exchange fins.

13. A room space, comprising:

a) side walls and a ceiling and a front wall;

b) said ceiling having:

i) peripheral first absorbent portions; and ii) a central diffusive portion comprising at least one lighting fixture having a translucent sound diffusive lens, said lens having a sound impervious diffusive surface designed in accordance with either mathematical number theory sequences or boundary element optimization techniques;

c) said side walls having an upper band of second absorbent portions adjacent said first absorbent portions and, below said second absorbent portions, said side walls have diffusive portions.

14. The room space of claim 13, wherein said front wall has a reflective surface.

15. A lighting fixture, comprising:

a) a base mountable within a room space;

b) a source of illumination mounted in said base;

c) a translucent sound impervious lens covering said source of illumination, whereby when said source of illumination is activated, light is visible through said lens; and d) said lens having an outwardly visible surface exposed to said room space, said outwardly visible surface having a surface configuration comprising a self-contained sound diffusor;

e) said diffusor including a plurality of elongated divided or non-divided wells having respective depths determined by either (1) a mathematical number theory sequence formula or (2) boundary element optimization techniques.

* * * * *